United States Patent [19]

Yuasa

[11] Patent Number: 4,637,708

[45] Date of Patent: Jan. 20, 1987

[54] ONE-COMPONENT COPIER TONER WITH ELECTRIC FIELD TRANSFER

[75] Inventor: Kazuhiro Yuasa, Zama, Japan

[73] Assignee: Ricoh Company, Ltd., Tokyo, Japan

[21] Appl. No.: 758,447

[22] Filed: Jul. 24, 1985

[30] Foreign Application Priority Data

Jul. 26, 1984 [JP] Japan ..... 59-156388
Jul. 26, 1984 [JP] Japan ..... 59-156389
Jul. 31, 1984 [JP] Japan ..... 59-158573

[51] Int. Cl.[4] ..... G03G 15/08

[52] U.S. Cl. ..... 355/3 DD; 355/14 D; 355/3 BE; 355/3 DR

[58] Field of Search ..... 355/3 DD, 140, 3 R, 355/3 DR, 3 BR, 3 TR, 14 TR

[56] References Cited

U.S. PATENT DOCUMENTS 4,164,372 8/1979 Gundlach et al. ..... 355/3 DD
4,194,830 3/1980 Ohnuma et al. ..... 355/3 DD
4,370,056 1/1983 Hays ..... 355/3 BE X
4,412,733 11/1983 Doutney ..... 355/3 DD
4,459,009 7/1984 Hays et al. ..... 355/3 DD
4,480,911 11/1984 Itaya et al. ..... 355/3 DD
4,505,573 3/1985 Brewington et al. ..... 355/3 DD

*Primary Examiner*—A. C. Prescott
*Attorney, Agent, or Firm*—Oblon, Fisher, Spivak, McClelland & Maier

[57] ABSTRACT

A one-component high-resistance toner is transferred from a rotatable sleeve, or first transport member, to an endless belt, or second transport member. An electric field having a predetermined intensity is developed between the sleeve and the belt in a direction for transferring the toner from the former to the latter. Toner particles charged to a polarity opposite to a desired polarity are prevented from moving from the sleeve toward the belt.

7 Claims, 18 Drawing Figures

Fig. 1
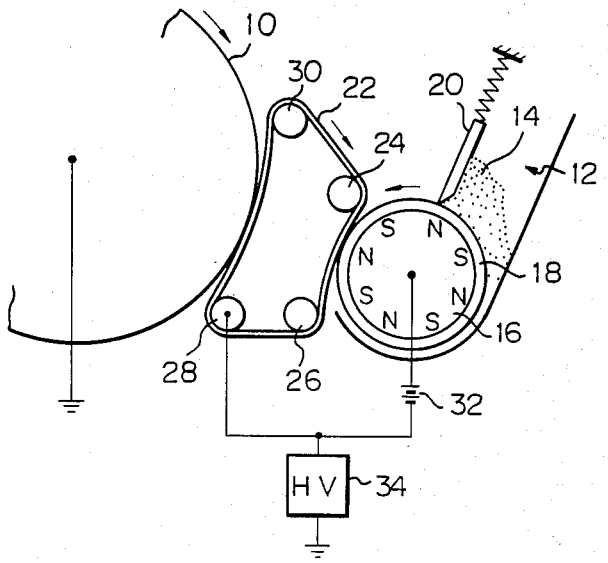
Fig. 3
Fig. 2
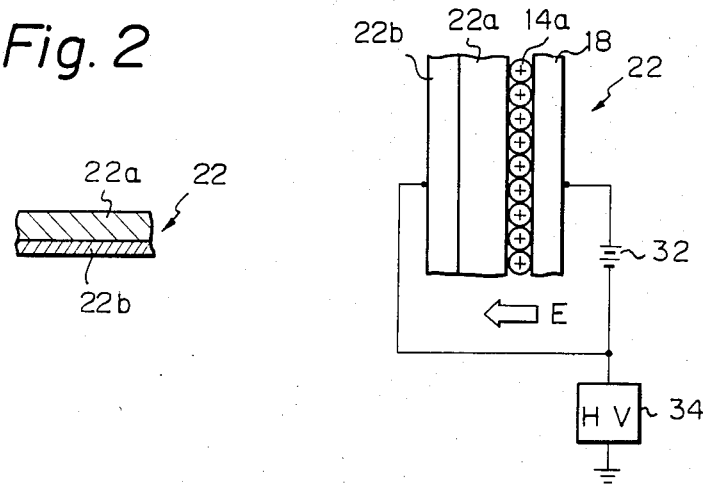

ONE-COMPONENT COPIER TONER WITH ELECTRIC FIELD TRANSFER

BACKGROUND OF THE INVENTION

The present invention relates to a recording apparatus applicable to a facsimile transceiver, copier and others for recording images on papers by means of a one-component high-resistance toner.

Some of recording apparatuses of the type described are implemented with an electrostatic recording system which uses specially treated papers for high-speed recording purposes. On the other hand, a transfer type electrostatic recording system which is operable with plain papers has been proposed as disclosed in, for example, Japanese Unexamined Patent Publication (Kokai) Nos. 58-7154 and 58-14160. If use could be made of a one-component high-resistance toner, the system using plain papers would offer various advantages such as a small-size developing unit configuration and, essentially, elimination of maintenance, as well known in the art. However, such a system is poor in reliability and does not easily allow a toner to be evenly charged, often resulting in an irregular density distribution in recorded images. Another and critical problem with the above system is that a part of the toner is unavoidably charged to a polarity opposite to a desired polarity so as to smear the background areas of recorded image patterns. Further, where the recording system concerned is applied to a transfer type electrostatic recording system in which recording electrodes directly make contact with a recording element, the toner obstructs the recording to cause omission of images.

A contrography recording system is also known in the art which uses light of the kind capable of directly recording images on plain papers. In this type of system, it has been customary to selectively apply a relatively high voltage to numerous electrodes, or styli, which are arranged in alignment with pixels. The problem with such a system is that a driver for applying such a voltage to the styli is intricate in construction and, therefore, expensive. Where it is desired to arrange a greater number of styli to increase the density and, thereby, set up a greater recording line density, the driver has to be furnished with a correspondingly greater number of styli driving sections, further adding to the intricacy of construction and cost.

SUMMARY OF THE INVENTION

It is therefore an object of the present invention to provide a recording apparatus which records high quality images on a paper by using a one-component high-resistance toner and, yet, eliminating the drawbacks otherwise brought about by an inversely charged part of the toner.

It is another object of the present invention to provide a contrography type recording apparatus which is desirably operable without a complicated styli driver.

It is another object of the present invention to provide an improved recording apparatus using a one-component high-resistance toner.

In accordance with one aspect of the present invention, there is provided a recording apparatus for recording image data on a recording medium by means of a one-component high-resistance toner which comprises a first toner transport member for transporting the toner which has been charged, a second toner transport member for transporting the charged toner, which is transported thereto by the first toner transport member, to the recording medium, and a toner transfer device for developing an electric field directed from the first toner transport member toward the second toner transport member to transfer the toner from the first toner transport member to the second toner transport member.

In accordance with another aspect of the present invention, there is provided a recording apparatus for recording image data on a recording medium by means of a one-component high-resistance toner which includes a toner transport member comprising a photoconductive layer containing a photoconductive material, a first conductive layer deposited on one of opposite major surfaces of the photoconductive layer and containing a conductive material, a second conductive layer deposited on the other major surface of the photoconductive layer and containing a conductive material which is transparent for light, and a surface layer deposited on the first conductive layer and containing an insulating material, the toner transport means transporting the toner which is deposited on the surface layer. A first power source applies a potential of a first polarity to the first conductive layer of the toner transport member. A second power source applies to the second conductive layer a potential of a second polarity which is opposite to the first polarity. A charging and depositing device charges the toner mainly to the second polarity so that the toner is deposited substantially evenly on the surface layer. An exposing device projects image light onto that part of the toner transport member where the toner is deposited, from a side of the toner transport member where the second conductive layer is positioned. The toner is transferred from the surface layer of the toner transport member to the recording medium, which is fed to between the electric field developing device and the toner transport member, by the electric field developed by the electric field developing device and responsive to an exposing state of the exposing device, thereby providing a toner image on the recording medium.

The above and other objects, features and advantages of the present invention will become more apparent from the following detailed description taken with the accompanying drawings.

BRIEF DESCRIPTION OF THE DRAWINGS

FIG. 1 is a schematic front view of a recording apparatus embodying the present invention;

FIG. 2 is a section of a conveyor belt included in the apparatus of FIG. 1;

FIG. 3 is a fragmentary view of the apparatus of FIG. 1;

DESCRIPTION OF THE PREFERRED EMBODIMENTS

Figure 4:
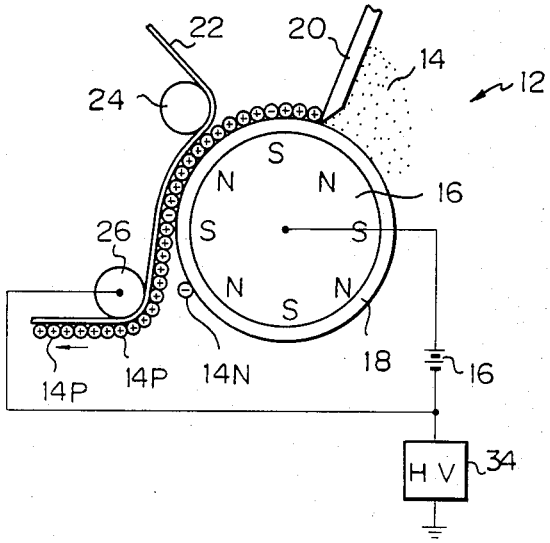
FIG. 4 is a schematic enlarged front view of a developing unit shown in FIG. 1 together with its neighborhood.

While the recording apparatus of the present invention is susceptible of numerous physical embodiments, depending upon the environment and requirements of use, substantial numbers of the herein shown and described embodiments have been made, tested and used, and all have performed in an eminently satisfactory manner.

Referring to FIGS. 1–5 of the drawings, a recording apparatus embodying the present invention is shown and includes a recording element 10. The recording element 10 is driven to rotate as indicated by an arrow while being provided with a latent image electrostatically thereon. A developing unit 12 is located in a developing station where it faces the recording element 10. The unit 12 may be of any suitable type insofar as it is operable with a one-component high-resistance toner 14. In this particular embodiment, the unit 12 comprises a developing sleeve 18 and a doctor blade 20 which remains in contact with the developing sleeve 18 at its tip. The sleeve 18 is made up of a rubber layer having a volume resistivity of the order of $10^5$ Ωcm and houses therein magnets 16, which are polarized as illustrated. The sleeve 18 serves as first toner transport means.

An endless conveyor belt 22 which serves as second toner transport means is located between the recording element 10 and the developing unit 12. The belt 22 comprises at least two layers. In this particular embodiment, the belt 22 has a dielectric layer **22*a* at its outer side and a conductive layer 22*b* at its inner side as shown in FIG. 2. The belt 22 are supported by, for example, four rollers 24, 26, 28 and 30 and rotated as indicated by an arrow. At least one of these rollers, roller 28 in the illustrative embodiment, is made of a conductive material and held in contact with the conductive layer of the belt 22**.

A power source 32 for applying a toner transfer bias is connected to the developing sleeve 18. The conductive roller 28, for example, is connected to ground. The reference numeral 34 designates developing bias means for providing an electric field for development. The whole developing system is supplied with a negative potential in the case of positive-to-positive development and with a positive potential in the case of negative-to-positive development.

In operation, the belt 22 is driven by drive means (not shown) as indicated by an arrow while, at the same time, the sleeve 18 is driven as indicated by an arrow. However, the sleeve 18 and the belt 22 do not always rotate at the same speed; usually, the former rotates several times faster than the former. In the developing unit 12, the toner 14 is charged due to friction with the doctor blade 20 as schematically illustrated in FIG. 3. In the illustrative embodiment, assume that the toner 14 is charged to a positive polarity by way of example. A toner layer **14*a* provided on the sleeve 18 is as thin as several-ten microns. Stated another way, the toner 14** fails to be sufficiently charged unless thinned to several-ten of micron.

Figure 6:
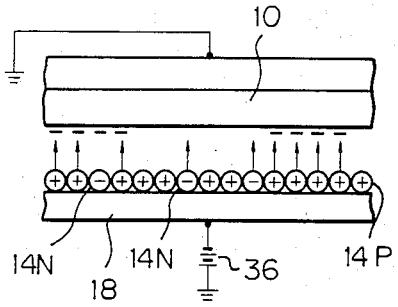
FIG. 6 is a view of a prior art recording apparatus.

A layer **22*a* of the charged toner is transported by the rotating sleeve 18. At this instant, even if the toner layer 22*a* is formed sufficiently thin, it is impossible to eliminate inversely charged (negatively in this particular embodiment) toner particles due to friction between the toner particles and other causes. Should the toner be transported to the developing station with inversely charged toner particles 14N mixed therewith as in the prior art system shown in FIG. 6, the toner particles 14N would become deposited on the background areas to smear them due to the electric field which is usually developed between developing bias means 36 and the recording element 10 to prevent a charged toner 14P** from adhering to background areas.

Figure 5:
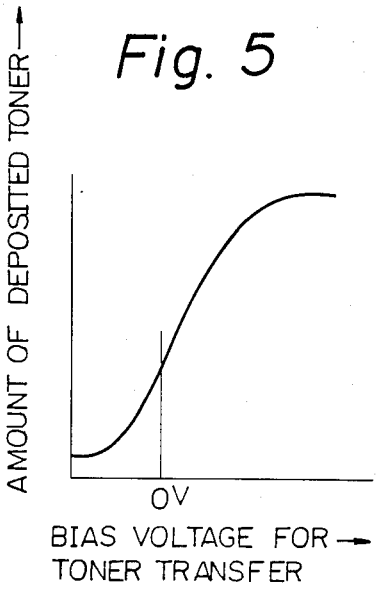
FIG. 5 shows a curve representative of a toner deposition amount against toner transfer bias characteristic.

In accordance with the illustrative embodiment, the toner is supplied from the sleeve 18 to the recording element 10 by way of the belt 22 and not directly from the sleeve 18 to the recording element 10. At first, the belt 22 is not charged and, therefore, its potential is uniform. In this condition, an electric field E is developed in one direction by the toner transfer bias provided by the power source 32, as shown in FIG. 3. Due to the electrical force of the electric field E, positively charged toner particles 14P on the sleeve 18 are transferred to the belt 22, while hardly any oppositely charged toner particles 14N are transferred to the belt 22 and, instead, returned to a hopper of the developing unit 12 by the sleeve 18 (see FIG. 4). The characteristic of the developing unit 12 is such that the amount of toner adhering to the belt 22 increases with the intensity of the electric field E, generally as represented by a curve in FIG. 5. As shown in FIG. 5, the amount of toner deposition on the belt 22 tends to reach saturation as the electric field E (value of toner transfer bias) increases in intensity beyond a certain one. It follows that if such a saturation range is used, the toner can be transferred evenly from the sleeve 18 to the belt 18 although the toner layer **14*a* on the sleeve 18** may be somewhat uneven.

The toner layer **12*a* deposited on the belt 22 as described above is carried by the belt 22 toward the recording element 10 so as to develop the latent image on the element 10. Since most of the toner particles on the belt 22 are the particles 14P of the desired polarity as previously stated, the toner is capable of developing the latent image without smearing the background areas by its negatively charged part 14N. In addition, the development is free from unevenness because the amount of toner supplied toward the element 10 is uniform as described. The resulting toner image on the element 10** is transferred to a paper at a transfer station and, then, fixed to provide a hard copy.

As described above, in accordance with this particular embodiment, although the use of the one-component high-resistance toner 14 entails inversely charged toner particles 14N, only the toner particles 14P which have been charged to the desired polarity are transferred from the sleeve 18 to the belt 22 by the electrical force, the belt 22 transporting the toner 14P to the developing station. Hence, the illustrated apparatus eliminates smearing of background areas otherwise caused by the toner particles 14N, omission of images, and other undesirable occurrences and, thereby, promotes high quality data recording.

Referring to FIGS. 7–11, another embodiment of the present invention is shown. In FIGS. 7–11, the same or similar structural elements as those shown in FIGS. 1–6 are designated by like reference numerals. What distinguishes this particular embodiment from the previously described one is the recording system. Specifically, an endless conveyor belt 40 is interposed between a paper (plain paper) 38 and the developing unit 12. Comprising a single-layer film, the belt 40 is passed over, for example, three rollers 42, 44 and 46 and driven as indicated by an arrow. Preferably, the belt 40 is less than 100 microns thick and has a volume resistivity of about $10^{10}$ Ωcm. The developing unit 12 faces the roller 42 with the belt 40 intervening therebetween.

A multi-stylus head 48 is located between the rollers 44 and 46 with its electrode surface abutting against the inner surface of the belt 40. The head 40 comprises an array of numerous electrodes in the form of styli 50 which extends in a main scan direction (perpendicularly to the sheet surface of FIG. 7). A spring 52 constantly urges the head 40 toward the belt 40. A conductive roller 54 faces such a multi-stylus head 48 with the intermediary of the belt 40 and paper 38. The roller 42 and the conductive roller 54 are each connected to ground. Connected to the sleeve 18 is the power source 32 for applying a toner transfer bias, or developing bias. A recording power source 56 is connected to the styli 50 in order to selectively apply voltage pulses thereto responsive to image data.

Figure 8:
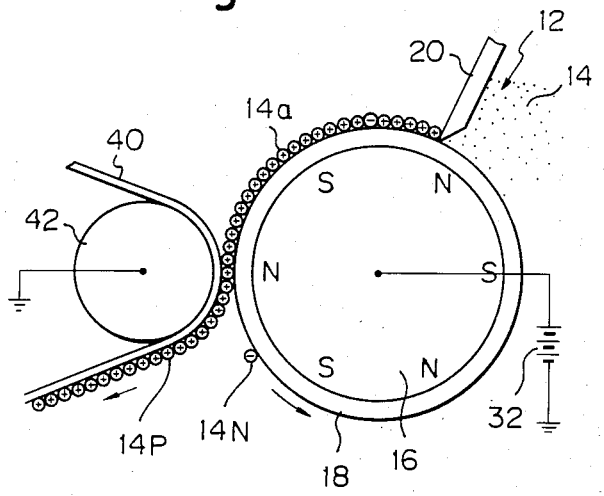
FIG. 8 is a schematic enlarged front view of a developing unit shown in FIG. 7 and its neighborhood.
Figure 9:
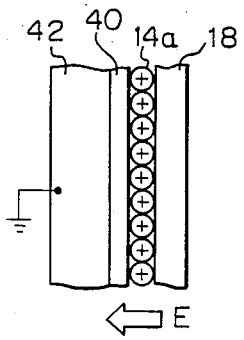
FIG. 9 is a fragmentary view of the apparatus of FIG. 7.

In operation, the belt 40 is driven as indicated by an arrow by drive means, not shown. The toner 14 is charged in the developing unit 12 due to friction with the doctor blade 20, as shown in FIG. 8. The toner layer **14*a*** itself is provided with a potential by the charged toner particles. Assuming that the charge deposited on the toner is uniform, the potential Vt of the toner layer is expressed as:

$$Vt=\rho t\cdot dt^2/2\cdot\epsilon O\cdot\epsilon t \quad (1)$$

where ρt is the volume charge density, dt is the thickness of the toner layer, and εt is the specific inductive capacity.

Figure 7:
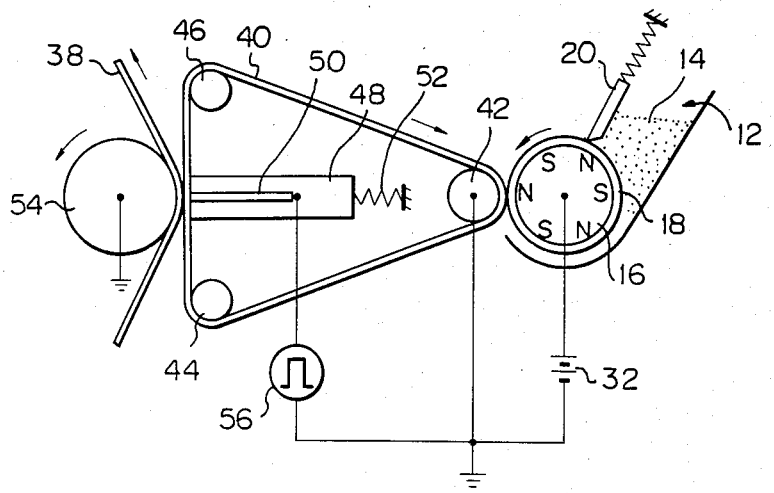
FIG. 7 is a schematic front view of a second embodiment of the present invention.

As shown in FIG. 8, the toner layer **12*a* is transferred to and evenly deposited on the belt 40 by the electrical force developed by the hardly charged belt 40 and the grounded roller 42. The mechanism of such toner transfer is equivalent to that of ordinary development. So long as the toner transfer to the belt 40 is derived from an electrical force, the only requisite is that the electric field E between the sleeve 18 and the belt 40 be be simply directed as indicated by an arrow in FIG. 9. In this regard, only the electric field provided by the toner layer voltage Vt which is represented by the equation (1) or the electric field developed by the toner transfer bias, which is provided by the power source 32 as shown in FIGS. 7 and 8**, may be used.

Figure 10:
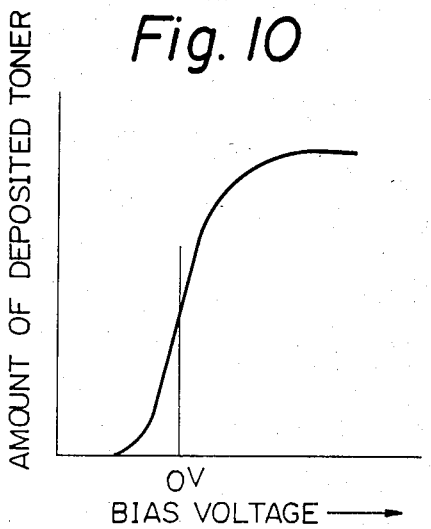
FIG. 10 shows a curve similar to the curve of FIG. 5.

Regarding the characteristic of the developing unit, the amount of toner deposition on the belt 40 increases with the intensity of the electric field E, generally as shown in FIG. 10. As shown, the amount of deposition tends to reach saturation at intensities of electric field (values of developing bias) higher than a certain one. Hence, where such a saturation range is used, the toner can be transferred evenly to the belt 40 even if the toner layer on the sleeve 18 is somewhat uneven. Hence, in this particular embodiment, too, the potential of the belt 40 is maintained constant and the developing unit 12 needs only to uniformly deposite the toner on the belt 40, so that even if the inversely charged toner 14N exists on the sleeve 18 due to the use of a high resistance toner, transfer of such toner 14N to the belt 40 is limited. That is, in the illustrative embodiment, only the positively charged toner 14P is deposited on the belt 40.

Figure 11:
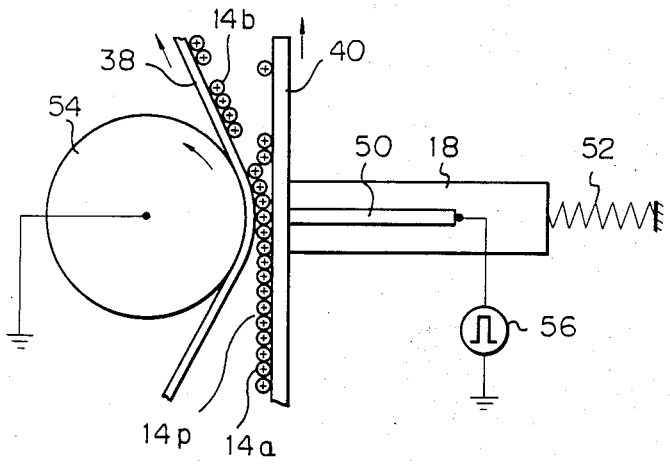
FIG. 11 is a schematic enlarged front view of a recording station.

In the above-described manner, the toner layer **12*a* deposited on the belt 40 is conveyed by the belt 40 itself toward the recording station where the multi-stylus head 48 is located. The power source 56 selectively applies high voltage pulses to the styli 50 responsive to an image signal. In those portions where the voltage pulses are applied, an electric field develops between the styli 50 and the conductive roller 54 which is of the kind causing repulsion of the positively charged toner layer 12*a*. As a result, the toner particles on the belt 40 are selectively transferred to the paper 38 to record desired data thereon, as shown in FIG. 11. In short, development occurs while the multi-stylus head 48 records data and, hence, the recording station bifunctions as a developing station. In the meantime, no inversely charged toner exist on the belt 40 so that smearing of the background areas and, therefore, degradation of recorded images is eliminated. In addition, since the head 48 and the toner layer 12*a* are located at opposite sides of the belt 40, that is, the head 48 is located at the rear (inside) of the belt 40, incomplete recording due to the toner particles does not occur. The toner image 12*b* provided on the paper 38** will then be fixed by fixing means (not shown) to provide a hard copy.

This particular embodiment, therefore, makes it needless to provide an independent developing station after the recording station, so that the resulting apparatus is small size and low cost. Further, it is highly reliable and capable of high quality data recording.

Figure 12:
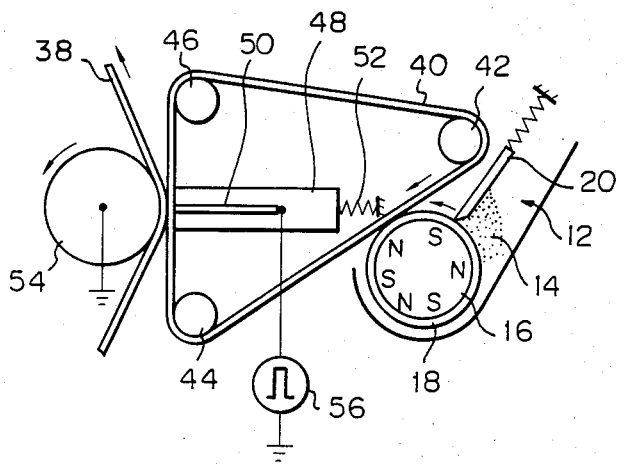
FIG. 12 is a schematic front view of a modification to the embodiment of FIG. 7.
Figure 13:
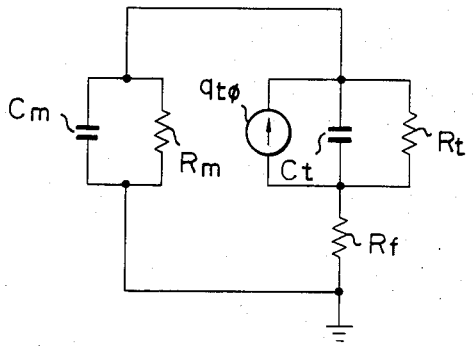
FIG. 13 shows an equivalent circuit associated with the modification of FIG. 12.

A modification to the embodiment of FIGS. 7–11 is shown in FIG. 12 which features a modified developing region. Specifically, the modification omits a developing bias and, instead, sets up an electrically floating developing condition. Even such a construction is capable of providing the toner layer **14*a*, as will be understood from an equivalent circuit of FIG. 13. In FIG. 13, Cm represents the capacitance of the belt 40, Rm the volume resistivity of the belt 40, Ct the equivalent capacitance of the toner layer 14*a*, Rt the equivalent resistance of the toner layer 14*a*, and qtϕ the charge deposited on the toner. Assuming that the floating resistance is Rf, the voltage Vt shown in the Eq. (1) is, equivalently, valid so that an electric field is developed to transfer the toner to the belt 40 and, thereby, provide the toner layer 14*a* thereon. However, because this electric field is not intense, the amount of toner deposition is smaller than the case wherein the the bias is used. This may be compensated for by increasing the linear velocity ratio of the sleeve 18 to the belt 40**.

While the first and second embodiments have been shown and described as charging the toner to the positive polarity, the polarity is open to choice and may even be negative. In that case, the polarity assigned to the other electric field developing means will be inverted. Further, the toner charging system may rely on charge injection in place of friction.

Advantages attainable with the first and second embodiments will be enumerated below.

(1) Since a one-component high-resistance toner is transferred from first toner transport means to second toner transport means by an electrical force and carried by the second transport means toward a developing position, the second transport means does not cause background areas to be smeared by inversely charged toner particles or cause images to be omitted. This enhances high quality development.

(2) Charged toner is evenly deposited on a conveyor belt to be carried thereby toward a recording position, while voltage pulses associated with image data are selectively applied to styli which are positioned at the opposite side to a toner deposition surface of the belt, whereby the toner is transferred to a paper to record desired data thereon. In this configuration, development occurs simultaneously with recording which is effected by the styli. Further, since the styli are not located on the same side as the toner deposition surface of the belt, they are prevented from being effected by the toner during recording operation. The apparatus, therefore, achieves significant reliability which realizes high quality recording and, in addition, a small-size and low-cost construction.

Figure 14:
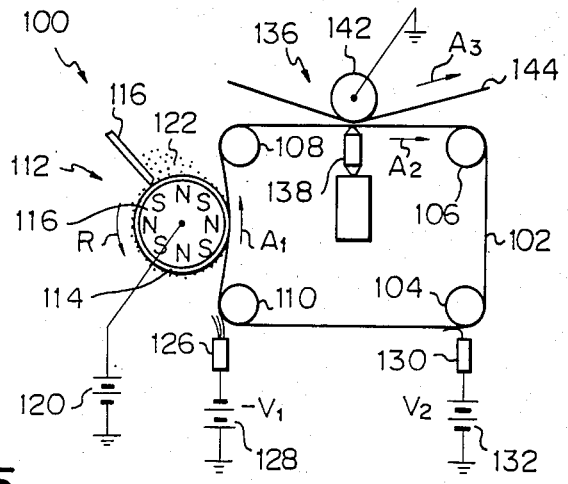
FIG. 14 is a schematic view of a third embodiment of the present invention.

Referring to FIG. 14, a recording apparatus in accordance with another embodiment of the present invention is shown and generally designated by the reference numeral 100. The apparatus 100 includes an endless belt 102 having a predetermined width and serving as a toner transport member. The belt 102 is passed over four rollers 104, 106, 108 and 110. Among these rollers, the roller 104 is driven by a motor or like drive source (not shown) to move at a predetermined speed as indicated by arrows A1 and A2.

Figure 15:
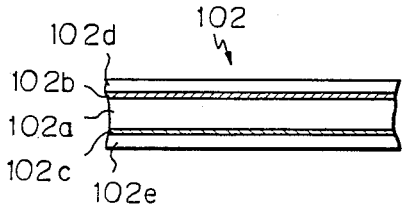
FIG. 15 is a section of a specific structure of a toner transport member included the embodiment of FIG. 14.

As shown in a section in FIG. 15, the belt 102 is made up of a photoconductive layer 102*a* containing a photoconductive material, two conductive layers 102*b* and 102*c* which are deposited on opposite sides of the photoconductive layer 102*a*, a surface layer 102*d* provided on the conductive layer 102*b*, and a surface layer 102*e* provided on the conductive layer 102*c*. The surface layer 102*e* serves as a protection layer for the conductive layer 102*c* and, preferably, is made of a material which is transparent for light. The conductive layer 102*c* is advantageously made of a transparent conductive material such as ITO which contains a material transparent for light.

Regarding the photoconductive layer 102*a*, use may advantageously be made of a material whose resistance RmD in the dark is far higher than a resistance RmL in the light. The materials of the conductive layers 102*b* and 102*c* are selected such that the resistance Rc1 of the former is higher than the resistance Rc2 of the latter, that is:

$$Rc2 < RmL < Rc1 << RmD \quad (2)$$

Figure 16:
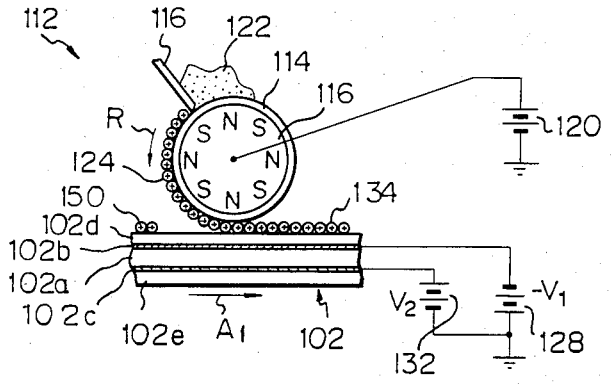
FIG. 16 is a view of a specific construction of a toner depositing section included in the embodiment of FIG. 14.

A toner depositing section 112 is located adjacent to the surface layer 102*d* of the belt 102. As shown in detail in FIG. 16, the toner depositing section 112 comprises a sleeve 114 and a doctor blade 116 which is held in slidable contact with the sleeve 114. The sleeve 114 is rotatable as indicated by an arrow R in slidable contact with the surface layer 102*d* of the belt 102. The sleeve 114 accommodates magnets 118 which are polarized to have poles N and S as illustrated, while being constantly applied with a predetermined potential, positive in the illustrative embodiment, by a power source 120.

A toner 122 is supplied in a position upstream of the doctor blade 116 with respect to a direction R in which the sleeve 114 is rotatable. While any kind of toner is usable insofar as it is of the one-component high-resistance type, this particular embodiment is implemented with a toner of the kind which will be positively charged by friction with the doctor blade 116 or the sleeve 114. As the sleeve 114 rotates in the direction R, a toner layer 124 which is positively charged and usually several-ten microns thick is provided on the sleeve 114.

Meanwhile, a power source 128 applies, in this particular embodiment, a negative potential −V1 to the conductive layer 102*b* of the belt 102 by way of electrical connecting means 126 such as a conductive brush (FIG. 14), which is slidably engaged with the conductive layer 102*b*. A power source 132 applies a positive voltage V2 to the conductive layer 102*c* via electrical connecting means 130 which is also slidably engaged with the conductive layer 102*c* and may also be implemented by a conductive brush. While the belt 102 moves in the direction A1, the toner layer 124 is transferred to the surface layer 102 of the belt 102 by an electric field which is developed between the toner depositing section 112 and the belt 102 by the power sources 120 and 128.

In more detail, the positively charged toner layer 124 shifts itself onto the surface layer 102*d* of the belt 102 due to the electric field which develops between the negative potential of the conductive layer 102*b* and the positive potential of the sleeve 114, thereby forming a toner layer 134 on the belt 102. Usually, where a toner having high resitance is used, a certain part of the toner is unavoidably charged to the opposite polarity to the desired polarity and it often constitutes a source of contamination of background areas, as previously discussed. In accordance with the illustrative embodiment, since the electric field set up from the sleeve 114 of the toner depositing section 112 toward the conductive layer 102*b* of the belt 102, negatively charged toner particles are prevented from being transferred to the belt 102. That is, only the positively charged particles are transferred to the surface layer 102*d* of the belt 102. The toner layer 134 deposited in this manner on the belt 102 has been evenly charged and is transported by the belt 102 due to coulomb force, which is exerted by the negative potential applied to the conductive layer 102*b*.

Figure 17:
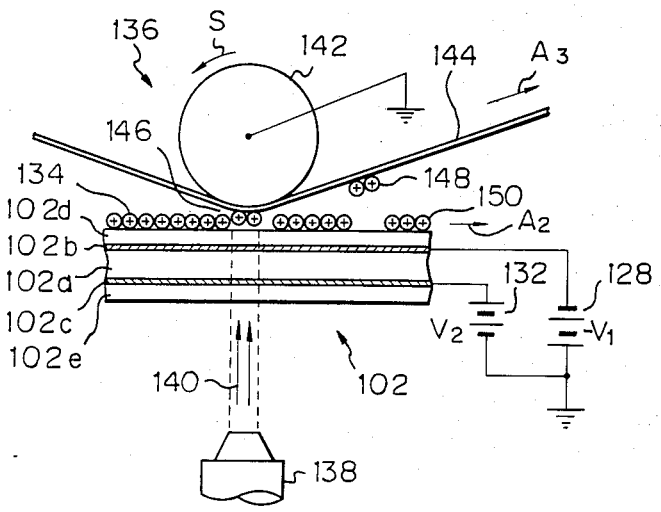
FIG. 17 is a view of a specific construction of a recording section included in the embodiment of FIG. 14.

As shown in FIG. 14, a recording section 136 is located at the downstream of the toner depositing section 112 with respect to the direction A1 in which the belt 102 is movable. An exposing section 138 is disposed near the transparent surface layer 102*e* of the belt 102. The exposing section 138 may comprise the same number of light-emitting means as a vertial array of pixels which define a single character line. The section 138 is movable along the width of the belt 102, that is, vertically to the sheet surface of FIG. 14. Alternatively, there may be used an exposing section which comprises light-emitting means arranged along the width of the belt 102 in correspondence with the pixels which define a single character line. As shown in FIG. 17, light issuing from the exposing section 138 is incident to the belt 102 from the transparent surface layer 102*e* side.

The light-emitting means of the exposing section 138 may advantageously be implemented by light sources which themselves have a switching function and are operable in a line-scanning mode, e.g. light emitting diodes or lasers. Another possible approach is controlling light from a constantly emitting light source by means of optical control elements which are capable of functioning as an optical shutter, e.g. electrooptical effect elements inclusive of liquid crystal and PLZT. In any case, where the illustrative embodiment is applied to a copier, the exposing section 138 may be constructed such that image light from a document is projected by optical fibers onto the belt 102 from the surface layer 102*e* side. Where it is applied to an output unit of a processing system, the arrangement may be such that the emitting condition is modulated by an output data signal of a processing system so as to project image light onto the belt 102.

As shown in FIG. 17, a roller 142 is located to face the exposing section 138 adjacent to the surface layer 102*d* of the belt 102. The roller 142 is rotatable as indicated by an arrow S and, electrically, it is maintained at a reference potential such as ground potential. A paper or like recording medium 144 intervenes between the roller 142 and the belt 102 and moves as indicated by an arrow A3 at substantially the same speed as the belt 102, which moves in the direction A2. The roller 142 is positioned such that the paper 144 remains in the close vicinity of the surface layer 102*d* of the belt 102 with a narrow gap 146 defined therebetween.

Figure 18:
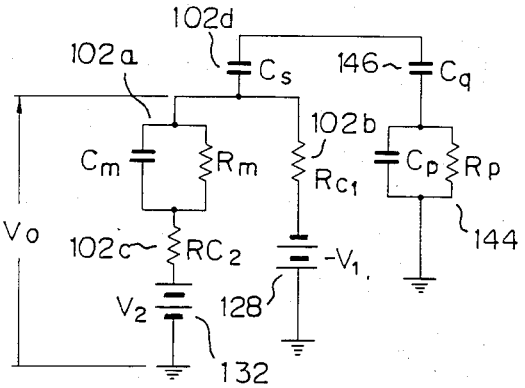
FIG. 18 shows an equivalent circuit representative of the recording section shown in FIG. 17.

The recording section 136 is represented by an electrical equivalent circuit in FIG. 18. In the equivalent circuit, Rp is the resistance of the paper 144. Cp the capacitance of the paper 144, Cg the capacitance of the gap 146, Cs the capacitance of the surface layer 102*d*, and Cm the capacitance of the photoconductive layer 102*a*. Concerning the potential of the conductive layer 102*b* in that part of the belt 102 which is positioned immediately below the roller 142, since the resistance RmD is far higher than Rc1 and others as previously stated, a potential VoD in an unexposed portion is substantially equal to the voltage −V1 of the power source 128, that is:

$$VoD \sim -V1 \quad (3)$$

As for the potential Vol in an exposed portion, since the resistance RmL is comparable with the resistance Rc1 and Rc2, it is produced by:

$$VoL=[Rc1 \cdot V2-(Rc2+RmL)V1]/(Rc1+Rc2+RmL) \quad (4)$$

As seen from the above expressions, that part of the toner which lies in a dark area on the belt 102 is equal in potential to VoD, i.e., substantially to the negative potential of the power source 128, so that it is left on the surface layer 102*d* of the belt 102 by the electric field developing between the conductive layer 102*d* and the roller 142. However, the rest of the toner which lies in a light area is repelled away from the belt 102 by the electric field which is directed from the conductive layer 102*c* toward the roller 142, because the potential of the conductive layer 102*b* overlying the conductive layer 102*c* is as expressed by the equation (4). As a result, this part of the toner is transferred to the paper 144 to become deposited thereon as represented by particles 148. That is, the voltages of power sources 128 and 132 should preferably be selected such that the positively charged toner 134 is repelled away from the belt 102 by the potential VoL which is determined by the equation (4). In other wards, it is preferable to select them such that the numerator in the equation (4) becomes positive.

In the manner described, the toner in those areas which are associated with relatively light portions of image light is transferred to the paper 144 with the result that a toner image associated with a signal or image light applied to the exposing section 138 is provided on the paper 144. Afterward, the toner 148 on the paper 144 will be semi-permanently fixed by an ordinary fixing unit (not shown). In the meantime, a residual part 150 of the the toner which has been left on the surface layer 102*d* of the belt 102 will be further conveyed by the belt 102 to be returned to the toner depositing section 112 and collected therein for reuse.

As described above, the apparatus in accordance with this particular embodiment can be implemented without resorting to a high-tension driver for driving styli of contrography on a pixel basis or a switching circuit associated with the driver. It also eliminates the need for a toner cleaning unit which has been essential for prior art photoconductive element type systems. Such simplifies the construction and cuts down the cost as well as space. In addition, it is free from ozone otherwise entailed by discharges and, therefore, deterioration of the photoconductive layer.

Various modifications will become possible for those skilled in the art after receiving the teachings of the present disclosure without departing from the scope thereof.

What is claimed is:

1. A recording apparatus for recording image data on a recording medium by means of a one-component high-resistance toner, comprising:

a rotatable sleeve for transporting the toner which has been charged;

a movable endless conveyor belt for transporting the charged toner, which is transported thereto by the rotatable sleeve which is in contact with the belt, to the recording medium;

toner transfer means for developing an electric field directed from the rotatable sleeve toward the belt to transfer the toner from the sleeve to the belt; and a multi-stylus head which has a number of electrodes in the form of styli which abut against the back of the belt which is opposite to the toner deposition surface of the belt, voltage pulses associated with the image data being applied to the styli.

2. A recording apparatus as claimed in claim 1, wherein the belt comprises a single-layer film.

3. A recording apparatus as claimed in claim 1, wherein the toner transfer means comprises biasing means for applying a bias across the sleeve and the belt.

4. A recording apparatus for recording image data on a recording medium by means of a one-component high-resistance toner, comprising:

a rotatable sleeve for transporting the toner which has been charged;

a movable endless conveyor belt for transporting the charged toner, which is transported thereto by the rotatable sleeve which is in contact with the belt, to the recording medium;

toner transfer means for developing an electric field directed from the rotatable sleeve toward the belt to transfer the toner from the sleeve to the belt; and wherein the belt comprises a photoconductive layer containing a photoconductive material, a first conductive layer deposited on one of opposite major surfaces of said photoconductive layer and containing a conductive material, a second conductive layer deposited on the other major surface of the photoconductive layer and containing a conductive material which is transparent for light, and a surface layer deposited on the first conductive layer and containing an insulating material and allowing the toner to be deposited on said surface layer.

5. A recording apparatus as claimed in claim 4, wherein the rotatable sleeve further comprises magnets disposed in the sleeve and each being provided with a predetermined polarity.

6. A recording apparatus as claimed in claim 4, further comprising exposing means for projecting image light onto that part of the belt where the toner is deposited, from a side of the second conductive layer, and electric field developing means located to face said exposing means and on a side of the belt where the surface layer is positioned for developing an electric field between said electric field developing means and the second conductive layer in a direction for attracting the toner.

7. A recording apparatus for recording image data on a recording medium by means of a one-component high-resistance toner, comprising:

toner transport means comprising a photoconductive layer containing a photoconductive material, a first conductive layer deposited on one of opposite major surfaces of said photoconductive layer and containing a conductive material, a second conductive layer deposited on the other major surface of the photoconductive layer and containing a conductive material which is transparent for light, and a surface layer deposited on the first conductive layer and containing an insulating material, said toner transport means transporting the toner which is deposited on said surface layer;

first power source means for applying a potential of a first polarity to the first conductive layer;

second power source means for applying to the second conductive layer a potential of a second polarity which is opposite to the first polarity;

charging and depositing means for charging the toner mainly to the second polarity so that the toner is deposited substantially evenly on the surface layer;

exposing means for projecting image light onto that part of the toner transport means where the toner is deposited, from a side of the toner transport means where the second conductive layer is positioned; and electric field developing means located to face said exposing means on a side of the toner transport means where the surface layer is positioned;

whereby the toner is transferred from the surface layer of the toner transport means to the recording medium, which is fed to between the electric field developing means and the toner transport means, by the electric field developed by the electric field developing means and responsive to an exposing state of the exposing means, thereby providing a toner image on the recording medium.

* * * * *